United States Patent [19]

Inoue

[11] 4,106,551

[45] Aug. 15, 1978

[54] ROLLER ASSEMBLY IN THE GUIDE PATH OF A CONTINUOUS CASTING MACHINE FOR BEAM BLANKS

[75] Inventor: Yuuji Inoue, Amagasaki, Japan

[73] Assignee: Concast AG, Zurich, Switzerland

[21] Appl. No.: 796,530

[22] Filed: May 13, 1977

[30] Foreign Application Priority Data

May 18, 1976 [JP] Japan ..... 51-63587[U]

[51] Int. Cl.[2] ..... B22D 11/12; B21B 13/10

[52] U.S. Cl. ..... 164/448; 29/116 R; 72/225

[58] Field of Search ..... 164/282, 442, 448; 72/224, 225, 226; 29/110, 124, 125, 130, 116 R

[56] References Cited

U.S. PATENT DOCUMENTS

| | | | |
|---|---|---|---|
| 1,156,986 | 10/1915 | Dunn | 72/225 |
| 2,256,193 | 9/1941 | Cobb | 29/116 R |
| 3,251,213 | 5/1966 | Noda | 72/225 |
| 3,335,596 | 8/1967 | Noda et al. | 72/225 X |

*Primary Examiner*—Francis S. Husar
*Assistant Examiner*—John S. Brown
*Attorney, Agent, or Firm*—Werner W. Kleeman

[57] ABSTRACT

A roller assembly which can be arranged in the guide path of a continuous casting machine for casting beam blanks, comprising first roller means for rotationally abutting against outer flange faces of the beam blank and second roller means for rotationally abutting against each pair of flange tips on either side of the beam blank. The rotational axes of the second roller means extending substantially perpendicular to the rotational axes of the first roller means. Third roller means rotationally abut against each web part of the beam blank. The rotational axes of the third roller means extend substantially coaxially with respect to the corresponding rotational axes of the second roller means. A second roller means and a third roller means on one side of the beam blank can rotate relative to one another.

7 Claims, 1 Drawing Figure

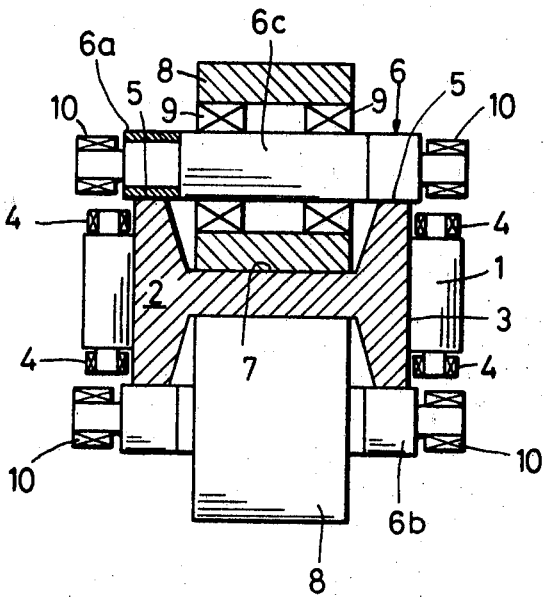
6c
6a
8
6
5
9
9
5
10
10
4
4
1
2
3
7
4
4
10
10
6b
8

ROLLER ASSEMBLY IN THE GUIDE PATH OF A CONTINUOUS CASTING MACHINE FOR BEAM BLANKS

BACKGROUND OF THE INVENTION

The present invention relates to a new and improved construction of a roller assembly capable of being arranged in the guide path of a continuous casting machine for the casting of sectional members, especially beam blanks, typically for instance I-shaped sections.

It is already known in this particular field of technology to support a beam blank in the guide path or the secondary cooling zone, respectively, of a continuous casting machine or installation, especially for casting steel, by positioning a plurality of rollers around the periphery of the beam blank section. With such prior art roller assembly construction there are provided lateral rollers having their rotational axes in a vertical plane and abuttingly engaging the outer flange faces of the casting. Further, radially extending web rollers are in abutting contact with the web part of the casting, and each flange tip of the casting is supported by a radially extending flange tip roller. This construction is both problematic and cumbersome owing to the multitude of bearing supports which are required. The alignment and assembly of each individual roller also requires a great deal of time. Additionally, the supported length of the web part or portion which extends transversely with respect to the direction of travel of the beam blank must be restricted because of the space which is needed to accommodate the bearing supports at either end of the web rollers. Hence, the unsupported sections of the web part oftentimes have a defective surface finish, leading to possible rejection of the finished product.

Now in order to overcome these difficulties, it has been further proposed to replace at each radial side of the casting one web roller and two flange tip rollers by a single roller unit which is supported at either end. The intermediate cylindrical portion of this roller unit has a larger diameter than the side cylindrical portions. The middle or intermediate cylindrical portion supports the web part or portion of the beam blank, whereas the side portions support its flange tips. While this modified construction of prior art roller assembly can be considered to constitute an improvement, nonetheless the life-span of such roller units is limited due to the difference in the peripheral speed of the intermediate or middle portion of the roller unit in comparison to that of the side portions of such roller unit. Moreover, due to this difference in peripheral speed or velocity, these roller units can cause skin drag on the still vulnerable solidified skin of the beam blank or casting, thereby causing metal breakouts and/or other surface defects.

SUMMARY OF THE INVENTION

Hence, with the foregoing in mind, it is a primary object of the present invention to provide an improved construction of roller assembly for use in the guide path of a continuous casting machine for cast sections, particularly beam blanks, which avoid the aforementioned drawbacks and limitations of the prior art proposals.

Another object of the present invention aims at providing a roller assembly, by means of which it is possible to support a beam blank to the fullest extent by means of rollers without any appreciable danger of damaging or flawing the surface of the cast beam blank.

Yet another object of the present invention aims at the provision of an improved construction of roller assembly employing rollers which can be adjusted, aligned, assembled and reassembled in the shortest possible time.

A further object is to provide rollers for a roller assembly which afford extended longevity.

Another object of this invention aims at the provision of a roller assembly employing a novel arrangement and construction of rollers affording maximum support of a cast section while minimizing the likelihood of impairing the surface finish of such cast section, to thereby provide for an improved finished product.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE illustrates a roller assembly located in the guide path of a continuous casting machine for casting sections, such as beam blanks, typically I-shaped sections, constructed according to the teachings of the present invention, and which roller assembly is shown partially in sectional view to better reveal certain of the internal structure.

DETAILED DESCRIPTION OF THE PREFERRED EMBODIMENTS

Describing now the drawing, there is illustrated a roller assembly which is disposed in the guide path of a continuous casting machine for casting sections, such as beam blanks 2, here shown in the form of I-sections. Since the invention relates to the novel construction of roller assembly details of the continuous casting machine have been omitted from the showing of the drawing to preserve clarity, particularly since the inventive roller assembly can be used with conventional continuous casting installations and such subject matter is not crucial to the understanding of the underlying concepts of the invention. In particular, it will be seen that the roller assembly of this development comprises a first roller means embodying the lateral rollers 1, each of which abuts against a neighboring outer flange face 3 of the beam blank 2. These lateral rollers 1 will be seen to extend in two essentially parallel vertical planes and each such roller 1 is supported by two bearing supports 4. A substantially cylindrical roller 8 abuts essentially over the entire width of a web part or portion 7 of the cast beam blank 2. This roller 8 is rotationally mounted by means of bearings 9 on a second roller means embodying a roller 6 which, in turn, is rotationally or rotatably supported on either end in bearing supports 10 located outside the flange faces 3 or the guide path, respectively, of the cast beam blank 2. At the opposite side of the web part 7 there is provided a similar arrangement of a larger diameter cylindrical roller 8 within which there is rotatably mounted the smaller size roller 6. The rotational axes of the rollers 6 extend in the curved radial plane of the roller apron in the secondary cooling zone of the continuous casting machine and are disposed substantially perpendicular to the corresponding rotational axes of the lateral rollers 1. The roller portions **6*b* of each of the rollers 6 neighboring the related bearing supports 10 at the inside thereof rotationally abut against the flange tips 5 of the beam blank 2, whereas the middle or intermediate portion 6*c* of each such roller 6 serves to support the third roller means constituted by the respective rollers 8. Each roller 6 and its corresponding roller 8 are substantially coaxially arranged, and, due to the provision of the bearings 9, these rollers 6 and 8** can advantageously rotate relative to one another.

In the exemplary embodiment under discussion the roller 6 is shown to be substantially uniformly cylindrical. However, it is possible and within the scope of the present invention, to construct the rollers 6 so as to possess a different configuration. For instance, the middle or intermediate roller portion 6*c*, which supports the related roller 8, may possess a greater diameter. Further, the end portions 6*b* of each of the rollers 6 which support the neighboring flange tips 5 may have a contoured configuration if such is desired. The sections or portions 6*b* of the rollers 6 which abut against the flange tips 5 may each be fitted with an exchangeable sleeve 6*a*, in order to prolong the service life of these rollers 6. Roller 8 and its corresponding roller 6 are assembled into a roller unit which can be easily adjusted and aligned. Since the roller 8 can rotate independently of its related roller 6, there is realized the beneficial result that skin drag is avoided, thereby improving the surface quality of the cast product. It is also possible for roller 8 to be exchanged by another roller 8 of different dimensions, for example different thickness and length, in order to accommodate other beam blank shapes.

While there are shown and described present preferred embodiments of the invention, it is to be distinctly understood that the invention is not limited thereto, but may be otherwise variously embodied and practiced within the scope of the following claims. Accordingly,

What I claim is:

1. A roller assembly for use in the guide path of a continuous casting machine for casting sections, especially beam blanks having a web portion and to each side thereof an outer flange having an outer flange face and flange tips, comprising:

first roller means for rotationally abutting against the outer flange faces of the beam blank;

second roller means for rotationally abutting against each pair of flange tips at each side of the beam blank;

said first roller means and said second roller means having rotational axes which extend substantially perpendicular to one another;

third roller means for rotationally abutting against opposite sides of the web portion of the beam blank;

the rotational axes of said third roller means extending substantially coaxially with respect to the corresponding rotational axes of said second roller means; and means for mounting the coaxial second roller means and third roller means on at least one side of the beam blank to rotate relative to one another.

2. The roller assembly as defined in claim 1, wherein:

said second roller means comprises a pair of rollers situated on opposite sides of the beam blank;

said third roller means comprises a pair of rollers situated on opposite sides of the beam blank;

each roller of said second roller means being located internally of the associated roller of said third roller means.

3. The roller assembly as defined in claim 2, wherein:

the rollers of the second roller means have a smaller diameter than the rollers of said third roller means.

4. A roller assembly for use in a continuous casting machine for casting sections, especially beam blanks having a web portion and to each side thereof an outer flange having an outer flange face and flange tips, comprising:

first roller means embodying a pair of rollers for rotationally abutting against the outer flange faces of the beam blank;

second roller means embodying a pair of roller located on opposite sides of the beam blank for rotationally abutting against each pair of flange tips at the opposite sides of the beam blank;

said first roller means and said second roller means having rotational axes which extend substantially perpendicular to one another;

third roller means embodying a pair of rollers located on opposite sides of the web portion for rotationally abutting against the opposite sides of the web portion of the beam blank;

the rotational axes of the rollers of said third roller means extending substantially coaxially with respect to the corresponding rotational axes of the rollers of said second roller means; and means for mounting a second roller means and a third roller means on at least one side of the beam blank to rotate relative to one another.

5. A roller assembly for use in a continuous casting machine for casting sections, especially beam blanks having a web portion and to each side thereof an outer flange having an outer flange face and flange tips comprising:

first roller means embodying a pair of rollers for rotationally contacting against the outer flange faces of the beam blank;

second roller means including at least one roller for rotationally contacting against a pair of flange tips at a given side of the beam blank;

said first roller means and said second roller means having rotational axes which extend substantially perpendicular to one another;

third roller means including at least one roller for rotationally contacting against the web portion of the beam blank at said given side thereof;

the rotational axis of said at least one roller of said third roller means extending substantially coaxially with respect to the rotational axis of said at least one roller of said second roller means; and means for mounting said at least one roller of said second roller means and said at least one roller of said third roller means at said given side of the beam blank for relative rotational movement with respect to one another.

6. The roller assembly as defined in claim 1 wherein:

the portions of the second roller means which abut the flange tips of the beam blank are fitted with replaceable sleeves.

7. The roller assembly as defined in claim 1 wherein:

the third roller means is rotatably journaled on an intermediate portion of the second roller means by means of bearings.

* * * * *